US011597107B2

(12) United States Patent
Stapelbroek

(10) Patent No.: US 11,597,107 B2
(45) Date of Patent: Mar. 7, 2023

(54) PROCESSING HEAD FOR A HAIR CUTTING APPLIANCE AND COMBINED BLADE UNIT

(71) Applicant: KONINKLIJKE PHILIPS N.V., Eindhoven (NL)

(72) Inventor: Martinus Bernardus Stapelbroek, Frieschepalen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 124 days.

(21) Appl. No.: 16/642,071

(22) PCT Filed: Aug. 23, 2018

(86) PCT No.: PCT/EP2018/072756
§ 371 (c)(1),
(2) Date: Feb. 26, 2020

(87) PCT Pub. No.: WO2019/042857
PCT Pub. Date: Mar. 7, 2019

(65) Prior Publication Data

US 2021/0362359 A1 Nov. 25, 2021

(30) Foreign Application Priority Data

Aug. 30, 2017 (EP) ..... 17188500

(51) Int. Cl.
*B26B 19/06* (2006.01)
*B26B 19/38* (2006.01)
*B26B 21/40* (2006.01)

(52) U.S. Cl.
CPC ..... *B26B 19/063* (2013.01); *B26B 19/3813* (2013.01); *B26B 21/4012* (2013.01)

(58) Field of Classification Search
CPC ... B26B 19/063; B26B 19/3813; B26B 19/06; B26B 19/38; B26B 21/4012; B26B 21/40
(Continued)

(56) References Cited

U.S. PATENT DOCUMENTS 4,922,608 A * 5/1990 Pahl ..... B26B 19/10 30/43.91
5,606,799 A * 3/1997 Melton ..... B26B 19/063 30/216

(Continued)

FOREIGN PATENT DOCUMENTS

DE 102008031132 7/2010
EP 0297300 1/1989

(Continued)

OTHER PUBLICATIONS

International Search Report and Written Opinion dated Nov. 22, 2018 for International Application No. PCT/EP2018/072756 Filed Aug. 23, 2018.

*Primary Examiner* — Nhat Chieu Q Do

(57) ABSTRACT

A processing head for a hair cutting appliance, the processing head comprising a powered blade set comprising a stationary blade and a movable blade, wherein the movable blade is arranged to be moved with respect to the stationary blade to cut hair between teeth of the movable blade and teeth of the stationary blade, a linkage unit supporting the powered blade set, wherein the linkage unit enables a contour following pivoting movement of the powered blade set when the appliance is operated to cut hair, and a razor cartridge that is arranged to be attached to the powered blade set in such a way that the powered blade set and the razor cartridge are pivotably supported by the linkage unit. Also, a combined blade unit and a hair cutting appliance that is equipped with a combined blade unit.

20 Claims, 6 Drawing Sheets

(58) Field of Classification Search
USPC ..... 30/43.3
See application file for complete search history.

(56) References Cited

U.S. PATENT DOCUMENTS

| | | | | |
|---|---|---|---|---|
| 5,669,138 | A | 9/1997 | Wetzel | |
| 9,533,422 | B2 * | 1/2017 | Perez-Lopez | B26B 19/3813 |
| 2005/0217115 | A1 | 10/2005 | Blaustein | |
| 2007/0101574 | A1 * | 5/2007 | Royle | B26B 19/3846<br>30/43.3 |
| 2009/0217531 | A1 | 9/2009 | Muraguchi | |
| 2010/0139097 | A1 | 6/2010 | Perez-Lopez | |
| 2011/0010943 | A1 | 1/2011 | Izumi | |
| 2011/0016723 | A1 | 1/2011 | Maichel | |
| 2013/0199346 | A1 * | 8/2013 | Psimadas | B26B 21/225<br>83/13 |
| 2018/0085934 | A1 * | 3/2018 | Erndt | B26B 19/40 |

FOREIGN PATENT DOCUMENTS

| | | |
|---|---|---|
| EP | 1410884 | 4/2004 |
| EP | 2243605 | 10/2010 |
| WO | 2015/074882 | 5/2015 |
| WO | 2016/001019 | 1/2016 |
| WO | 2016/042158 | 3/2016 |

* cited by examiner

PROCESSING HEAD FOR A HAIR CUTTING APPLIANCE AND COMBINED BLADE UNIT

CROSS REFERENCE TO RELATED APPLICATIONS

This application is the U.S. National Phase application under 35 U.S.C. § 371 of International Application No. PCT/EP2018/072756 filed Aug. 23, 2018, published as WO 2019/042857 on Mar. 7, 2019, which claims the benefit of European Patent Application Number 17188500.7 filed Aug. 30, 2017. These applications are hereby incorporated by reference herein.

FIELD OF THE INVENTION

The present disclosure relates to a processing head for a hair cutting appliance and to a combined blade unit that incorporates a powered blade set and a razor blade. More specifically, but not to be understood in a limiting sense, the present disclosure also relates to contour following mechanisms for hair cutting appliances that enable a certain pivoting movement of blade sets when the appliance is operated.

BACKGROUND OF THE INVENTION

EP 1 410 884 A1 discloses a shaving apparatus comprising a drivable shaving unit having a skin-engaging cutter for performing a first shaving action on a user's skin; a motor adapted to drive said shaving unit to perform said first shaving action; a blade having a razor-sharp cutting edge positioned for shaving engagement with the user's skin; and a guard surface provided in front of said razor-sharp cutting edge, whereby said blade performs a second shaving action to cut hair during use of said shaving unit to perform said first shaving action.

EP 0 297 300 A1 discloses a dry shaving apparatus comprising a housing, a drive assembly and a shearing head including at least one arcuate short hair cutter assembly and at least one long hair cutter assembly associated therewith, said shearing head being pivotally mounted on said housing about a pivot axis extending in the longitudinal direction of said shearing head.

Contour following mechanisms have a positive effect on the user comfort as a relatively close contact between the blade set and the skin can be maintained. Contour following mechanisms may involve hinges and linkage mechanisms to induce a certain adjustment movement in reaction to external forces acting on the blade set.

An exemplary design of a contour following mechanism for a hair cutting appliance is disclosed in WO 2015/074882 A1. It is proposed therein to implement the contour following mechanism in a hair cutting appliance that utilizes a double-walled stationary blade having a top wall and a bottom wall that jointly define a guide slot for a movable blade that is movably received therein. The blade set that is composed of the stationary blade and the movable blade is, on the one hand, suited for trimming procedures. However, due to the double-walled shape of the stationary blade, the top wall thereof that is facing the skin when in operation may be arranged to be considerably thin. Therefore, to some extent, the blade set is also operable for shaving procedures, styling procedures, etc.

Manufacturing approaches to double walled stationary blades are disclosed in WO 2016/001019 A1 and WO 2016/042158 A1 that describe arrangements wherein at least the top wall of the stationary blade is at least substantially made from sheet metal material. In both documents, an integral design of metal parts and non-metal parts is proposed, involving integrally manufacturing sheet metal and injection molding parts. Hence, insert molding and/or overmolding are proposed to combine the benefits of metal components and non-metal molded components.

However, it has been observed that the achievable smoothness of the shave does not in each case equal the smoothness of a conventional wet shaving procedure using a razor.

There exist several approaches to combine trimming blade sets and razor blades in one appliance. However, the trimming blade set and the razor blade are typically arranged at distinct and different positions at the housing of a hair cutting appliance. In this context, reference is made to any of EP 2 243 605 A1, US 2011/0010943 A1, and US 2005/0217115 A1. These references describe multi-purpose hair cutting apparatuses having razor blades and trimmer blades. However, these documents illustrate conventional design approaches, wherein the trimmer blade and the razor blade are considerably spaced from one another, and/or wherein relatively complicated mechanisms are to be operated to switch between a trimming mode and a shaving mode. This makes the apparatuses bulky and results in a cumbersome operation.

Hence, a user has to change the grip to switch between a trimming operation mode and a shaving operation mode, or to actuate a mechanism that displaces one of the trimming blade and to razor blade. Further, even if a contour following mechanism is provided for one of the trimming blade set and the razor blade, one and the same contour following mechanism cannot be used for both the trimming blade set and the razor blade. Further, it is difficult and often even impossible to use the razor blade and the trimmer blade simultaneously.

To achieve a certain performance level for both trimming procedures and shaving procedures, many users still tend to use two separate devices.

Hence, in this respect, there is still room for improvement in the design of blade sets for hair cutting appliances.

SUMMARY OF THE INVENTION

In view of the above, it is an object of the present disclosure to present a combined processing head for a hair cutting appliance that addresses at least some of the aforementioned drawbacks. Preferably, the processing head enhances and extends the field of application of the hair cutting appliance. It would be desirous to present a single appliance that is capable of trimming, shaving, styling, and, in addition thereto, of smooth wet shaving using a razor blade. Hence, it is desirable to present a combined device that enables a user to perform several grooming procedures without the need of using two or even more devices.

Further, the processing head is preferably arranged in such a way that the appliance that is equipped with the processing head has a compact design and is generally easy to manufacture. However, the operating performance both in a trimming operation mode and a wet shaving operation mode shall be good enough and convincing so that the user is not prompted to use separate devices.

Further, preferably, a contour following capability of the appliance shall be provided and maintained both in the trimming operation mode and the wet shaving operation mode.

In a first aspect of the present disclosure there is presented a processing head for a hair cutting appliance, the processing head comprising:

a powered blade set comprising a stationary blade and a movable blade, wherein the movable blade is arranged to be moved with respect to the stationary blade to cut hair between teeth of the movable blade and teeth of the stationary blade, a linkage unit supporting the powered blade set, wherein the linkage unit enables a contour following pivoting movement of the powered blade set when the appliance is operated to cut hair, and a razor blade that is arranged to be attached to the powered blade set in such a way that the powered blade set and the razor blade are pivotably supported by the linkage unit.

The present disclosure is based on the idea that the powered blade set that is provided with a contour following feature may be operated as a carrier for the razor blade. When the razor blade is supported by the powered blade set in a pivotable fashion, also the razor blade is provided with a contour following feature.

When the razor blade is attached to the powered blade set, particularly to the stationary blade thereof, cutting edges and leading edges of the involved blades are arranged close to one another. Preferably, the razor blade is arranged in the vicinity of a leading edge of the powered blade set that is formed by a series of teeth thereof. Hence, a basically similar orientation of the appliance in the shaving mode and the trimming mode is possible. This has the effect that no considerable reorientation or grip change for the appliance is necessary when the user switches between the powered blade set and the razor blade.

It is to be noted that in another operation mode, in certain embodiments, the user may simultaneously operate the powered blade set and the razor blade as they are positioned next or adjacent to one another in respectively adapted orientations. Hence, at least in some embodiments, cutting edges of the razor blade and a neighboring leading edge of the powered blade set are positioned and/or at least substantially aligned to enable simultaneous skin contact for both the razor blade and the powered blade set in respectively operable orientations in relation to the skin level. As a result, the used may first trim hair and subsequently shave remaining stubbles in one combined shaving procedure, even in one stroke.

In accordance with exemplary embodiments, the razor blade is attached to a skin-facing top wall of the stationary blade of the blade set.

In an exemplary arrangement of the processing head, the razor blade is permanently attached to the powered blade set. In other words, the razor blade is fixedly attached to the powered blade set in a non-detachable manner.

In yet another exemplary embodiment, the razor blade is bonded or molded to the powered blade set. In accordance with this embodiment, the powered blade set and the razor blade may be integrally manufactured and/or assembled using manufacturing techniques such as insert molding, outsert molding, overmolding, etc.

In yet another exemplary embodiment of the processing head, the razor blade is removably attached to the powered blade set. Hence, the razor blade is detachable, for instance for replacement.

In still another exemplary embodiment of the processing head, a snap-lock interface is formed between the razor blade and the powered blade set. Hence, attaching and detaching the razor blade does not require additional tools.

In yet another exemplary embodiment of the processing head, the razor blade is arranged at a top side of the powered blade set. Preferably, the razor blade is arranged at the top wall of the stationary blade that may also be referred to as guard wall or first wall.

It is generally preferred that the razor blade and the powered blade set are positioned very close to one another.

In yet another exemplary embodiment of the processing head, the razor blade is provided with a cutting edge that is parallel to a leading edge of the powered blade set that is defined by the tips of the teeth of the stationary blade. In this way, generally one and the same advancing direction may be used to move the appliance along the skin in both the trimming mode and the shaving mode.

In yet another exemplary embodiment of the processing head, the linkage unit defines a virtual pivot axis for the powered blade set and the razor blade. A virtual pivot axis may also be referred to as instantaneous pivot axis. A virtual pivot axis may be defined using a linkage having several links that are movable with respect to one another so that a resulting pivoting movement for the blade set is achieved. A virtual pivot axis may be placed "above" the top wall of the stationary blade in a region where it is basically impossible to provide a discrete link providing a corresponding pivot axis.

In yet another exemplary embodiment of the processing head, the linkage unit is a four-bar linkage unit. Other types of linkage units having a smaller or higher number of joints are conceivable.

In another exemplary embodiment of the processing head, the four-bar linkage unit comprises a first side bar, a second side bar and a top bar, wherein the first side bar and the second side bar are spaced away from one another, wherein the top bar is arranged between a top end of the first side bar and a top end of the second side bar, and wherein a bottom side of the powered blade set is arranged at or forms the top bar.

Using a four-bar linkage unit involves a great freedom of design so that desired characteristics of the contour following feature can be achieved by adjusting the linkage unit.

In yet another exemplary embodiment of the processing head, at least one hinge of the linkage unit is formed as a living hinge. Generally, a living hinge is formed by a defined weak point having only a very small wall thickness. The use of living hinges may generally reduce manufacturing costs, assembly costs, etc.

In yet another exemplary embodiment of the processing head, the razor blade is inclined with respect to the powered blade set in such a way that the processing head is operable to engage the user's skin with the powered blade set and the razor blade simultaneously in one stroke. Preferably, first the powered blade set and second the razor blade approaches a particular processing zone to cut hair. In other words, a dual-action two-stage shaving procedure may be performed, wherein a particular skin portion is first contacted by the leading edge of the powered blade set (for a trimming-style cutting action) and thereafter contacted by the cutting edge of the razor blade (for a shaving-style cutting action). Hence, a smooth shave may be achieved in only one go.

In still another exemplary embodiment of the processing head, the razor blade is inclined with respect to the powered blade set in such a way that the processing head is operable in a first operating orientation for the powered blade set, and a second operating orientation for the razor blade, wherein the first operating orientation and the second operating orientation are inclined in relation to one another by an angle of less than 30 degrees, preferably less than 15 degrees, more preferably less than 10 degrees. As with the dual-action embodiment discussed hereinbefore, basically a nearly aligned arrangement of the first operating orientation and the second operating orientation is useful to have a basically parallel (simultaneous) interaction of the powered blade set and the razor blade with the skin.

Hence, in some embodiments, the inclination angle between the first operating orientation and the second operating orientation approaches zero. This may involve an embodiment, wherein an imaginary line that connects cutting edges of the blades of the razor blades also intersects or at least approaches the leading edge of the powered blade set. However, as the human skin is generally relatively soft, also a certain inclination angle between the first operating orientation and the second operating orientation may be accepted as both the powered blade set and the razor blade may still simultaneously contact the skin to cut hair there.

The first operation orientation involves a certain operating angle for the powered blade set. The second operation orientation involves a certain operating angle for the razor blade that is different from the operating angle of the first operation orientation. The operating angle describes an inclination of the appliance with respect to the skin of the user whose hair is to be processed/cut.

As indicated above, it is not necessary to use the appliance in a totally deviating orientation in the second operating mode. Switching between the first operating mode and the second operating mode involves a relatively small tilting movement. Optionally, also a combined operating mode for trimming and shaving in one go is possible.

In yet another exemplary embodiment of the processing head, at a stroke movement of the processing head, depending on an angular orientation of the processing head, one of the razor blade and the powered blade set contacts the skin in a respective operating orientation.

In other words, for shaving procedures, the processing head is brought into a first inclination with respect to the skin. For the trimming or styling operation, the processing head is brought into a second inclination with respect to the skin. Preferably, the transition between the two operating orientations does not involve excessive movements.

In another aspect of the present disclosure there is presented a combined blade unit for a hair cutting appliance, the blade unit comprising:

- a powered blade set comprising a stationary blade and a movable blade, wherein the movable blade is arranged to be moved with respect to the stationary blade to cut hair between teeth of the movable blade and teeth of the stationary blade, and
- a razor blade that is arranged to be attached to the powered blade set in such a way that the powered blade set and the razor blade are together pivotally supported by a linkage unit,
- wherein the razor blade is arranged at a top side of the powered blade set,
- wherein a mounting interface is provided at a bottom side of the powered blade set, and
- wherein the blade unit is arranged to be coupled with a hair cutting appliance via a linkage unit that pivotally supports the powered blade set and the razor blade.

In an exemplary embodiment of the combined blade unit, the powered blade set is arranged to be detachably attached to the hair cutting appliance via the linkage unit.

In yet another aspect of the present disclosure there is presented an electrically powered hair cutting appliance, said hair cutting appliance being arranged to be moved through hair in a moving direction to cut hair, said hair cutting appliance comprising a processing head in accordance with at least one embodiment as described herein that is fitted with a combined blade unit comprising a powered blade set and a razor blade.

In yet another aspect of the present disclosure there is presented a hair cutting appliance arranged to be moved through hair in a moving direction to cut hair, the appliance comprising a processing head in accordance with at least one embodiment as discussed herein. The processing head is fitted with a combined blade unit comprising a powered blade set and a razor blade.

Optionally, the appliance comprises a housing comprising a handle section and a drive unit arranged in the housing.

Generally, the powered blade set may comprise a basically linear leading edge defined by a respective series of stationary blade teeth (and movable blade teeth). In accordance with this embodiment, a basically reciprocating and substantially linear relative movement between the movable blade and the stationary blade is present. However, this does not exclude embodiments, wherein an at least somewhat curved (oscillatory) movement path of the movable blade with respect to the stationary blade is present. This may be caused, for instance, by a respective guiding linkage for the movable blade.

Further, in addition to basically linear arrangements of the blade set, also curved or even circular arrangements of the blade set may be envisaged. Hence, accordingly, a somewhat curved or circular leading edge defined by a respective arrangement of stationary blade teeth (and movable blade teeth) may be provided. Therefore, whenever reference herein is made to a longitudinal direction, a lateral direction and/or a height direction, this shall not be interpreted in a limiting sense. A curved or circular blade set may be defined and described with reference to similar directions, but also with reference to polar directions and/or further appropriate directional information. Hence, Cartesian coordinate systems, but also polar coordinate systems and further appropriate coordinate systems may be used to describe linear and/or curved designs of the blade set.

In some embodiments, the powered blade set is provided with two opposite leading edges, i.e. two opposite series of stationary blade teeth and movable blade teeth. In this way, both a pulling and a pushing movement of the powered blade set may be used for the cutting operation. Further, in this way the hair cutting appliance can be deployed more flexibly which may facilitate styling operations and hair cutting operations in hard-to-reach areas.

BRIEF DESCRIPTION OF THE DRAWINGS

These and other aspects of the invention will be apparent from and elucidated with reference to the embodiments described hereinafter. In the following drawings

DETAILED DESCRIPTION OF THE EMBODIMENTS

Figure 1:
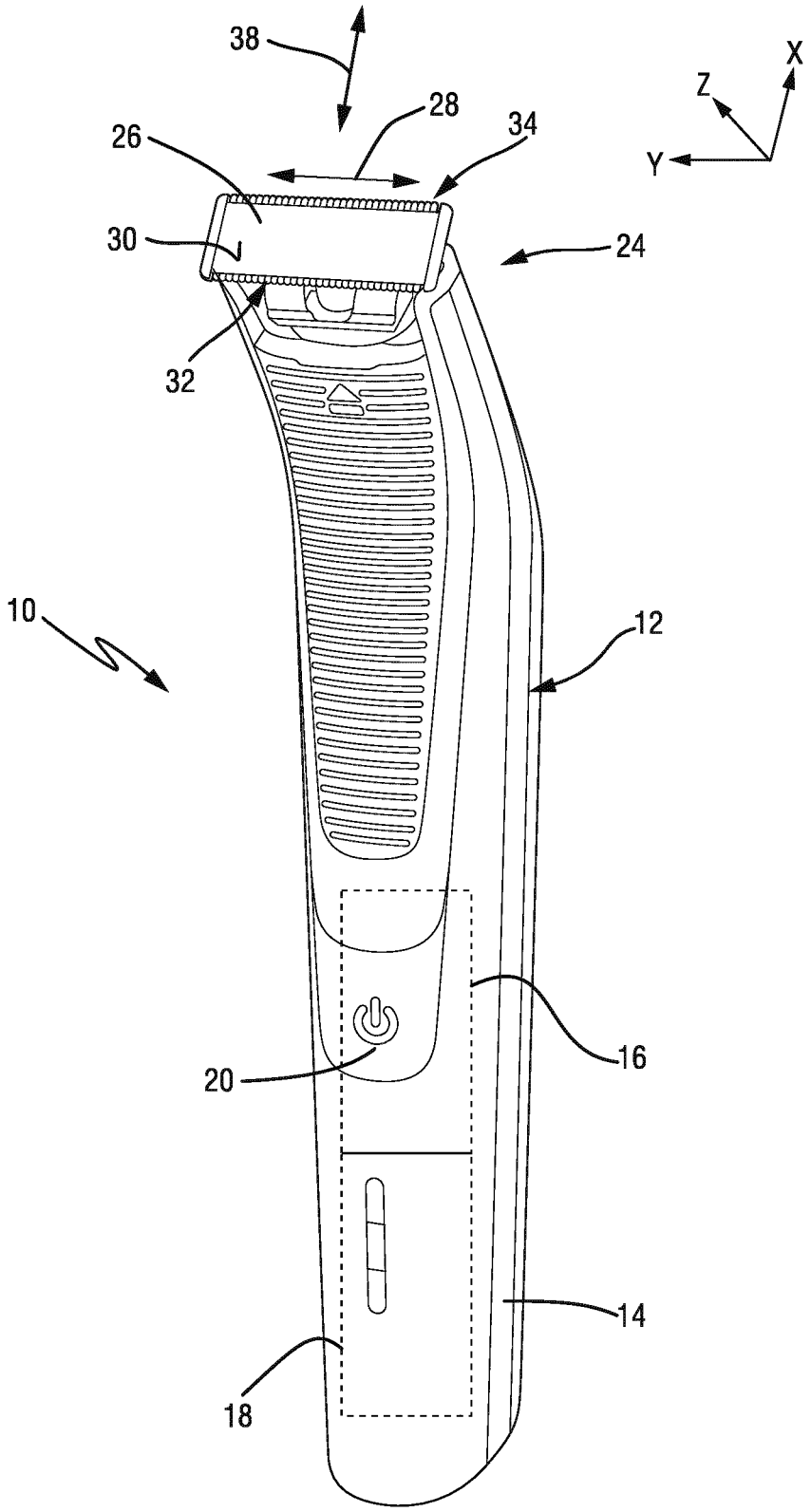
FIG. 1 shows a perspective frontal view of an exemplary embodiment of a hair cutting appliance.

FIG. 1 shows a perspective frontal view of a hair cutting appliance 10. The hair cutting appliance 10 is arranged as an appliance that is capable of both trimming and shaving.

The appliance 10 comprises a housing 12 which is arranged in an elongated fashion. At the housing 12, a handle section 14 is defined. In the housing 12, a drive unit 16 is arranged. Further, a battery 18 may be arranged in the housing 12. In FIG. 1, the drive unit 16 and the battery 18 are represented by dashed blocks. At the housing 12, operator controls 20 such as on/off buttons and the like may be provided.

At a top end thereof, the appliance 10 comprises a processing head 24 that is attached to the housing 12. The processing head 24 comprises a blade set 26. The blade set 26, particularly a movable blade thereof, may be actuated and driven by the drive unit 16 in a reciprocating fashion, refer also to the double arrow 28 in FIG. 1. As a result, respective teeth of the blades of the blade set 26 are moved with respect to one another, thereby effecting a cutting action. A top side or top surface of the blade set 26 is indicated by 30 in FIG. 1.

The blades of the blade set 26 may be arranged at a first leading edge 32 and, in at least some embodiments, at a second leading edge 34 that is opposite to the first leading edge 32. The first leading edge 32 may be also referred to as frontal leading edge. A second leading edge 34 may be also referred to as rear leading edge.

Further, a general advancing or moving direction of the appliance 10 is indicated in FIG. 1 by a double arrow 38. As the blade set 26 of the exemplary embodiment of FIG. 1 is equipped with two leading edges 32, 34, a push and a pull movement may be used to cut hair.

In the following, exemplary embodiments of the stationary and blade set 26 will be elucidated and described in more detail. The blade set 26 may be attached to the appliance 10, or to a similar appliance. It goes without saying the single features disclosed in the context of a respective embodiment may be combined with any of the other embodiments, also in isolated fashion, thereby forming further embodiments that still fall under the scope of the present disclosure.

In some Figures shown herein, exemplary coordinate systems are shown for illustrative purposes. As used herein, an X-axis is assigned to a longitudinal direction. Further, a Y-axis is assigned to a lateral direction. Accordingly, a Z-axis is assigned to a vertical (height) direction. Respective associations of the axes/directions X, Y, Z with respective features and extensions of the blade set 26 can be derived from those Figures. It should be understood that the coordinate system X, Y, Z is primarily provided for illustrative purposes and not intended to limit the scope of the disclosure. This involves that the skilled person may readily convert and transform the coordinate system when being confronted with further embodiments, illustrations and deviating view orientations. Also a conversation of Cartesian coordinate systems into polar coordinate system may be envisaged, particularly in the context of a circular or curved blade set.

Figure 2:
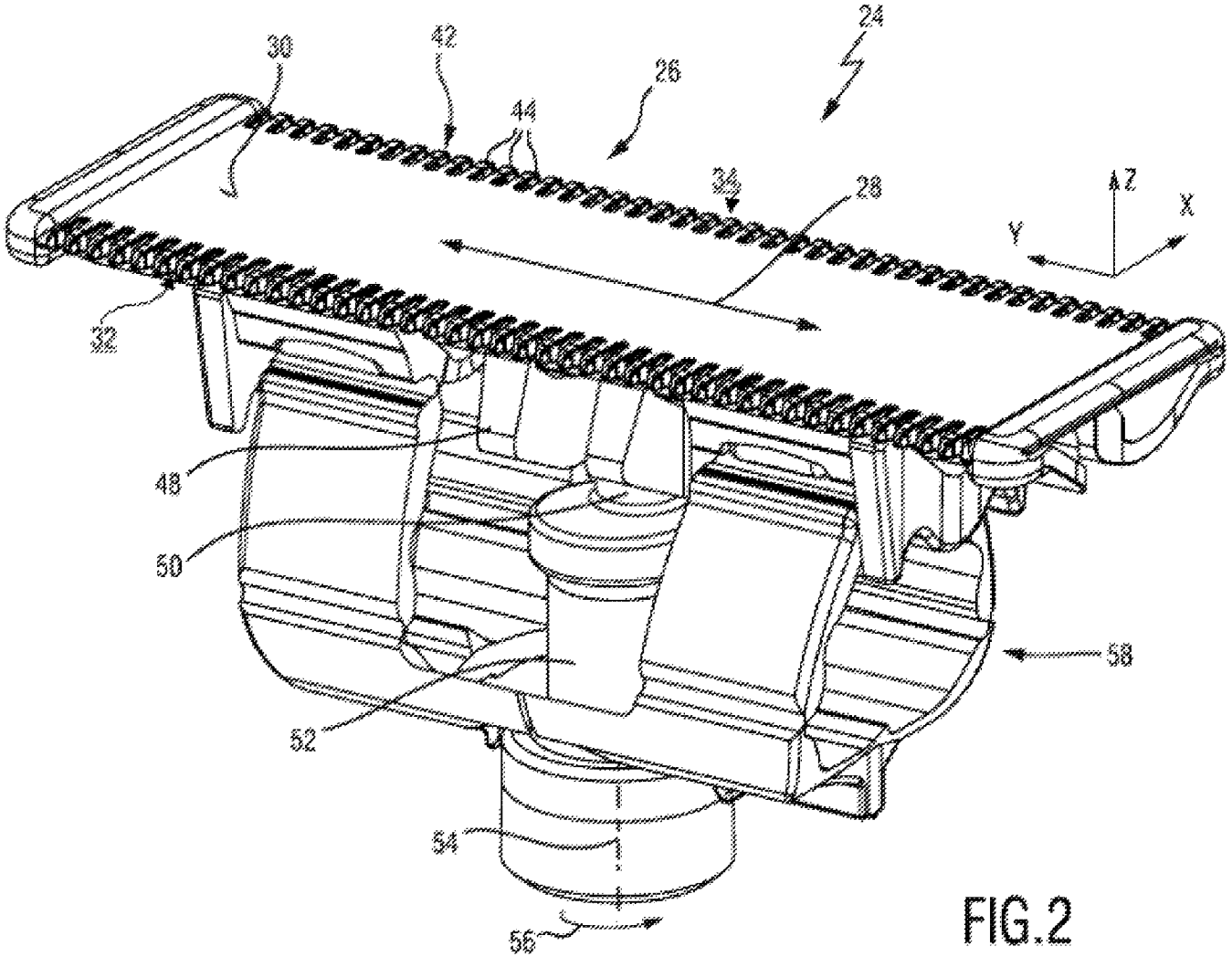
FIG. 2 shows a perspective top view of an exemplary embodiment of a blade set for a hair cutting appliance.

In FIG. 2, a perspective view of a blade set 26 for a processing head or cutting head 24 of a hair cutting appliance 10 is shown. As with the embodiment shown in FIG. 1, a cutting direction and/or a direction of a relative movement of blades of the blade set 26 is indicated by an arrow 28. A top side of the blade set 26 that is facing the user when the appliance 10 is operated is indicated by 30. In the exemplary embodiment shown in FIG. 2, the blade set 26 is provided with a first leading edge 32 and a second leading edge 34. In FIG. 2 a stationary blade 42 of the blade set 26 is shown. A movable blade (cutter blade) is covered by the stationary blade 42 in FIG. 2. Stationary blade teeth are indicated by 44.

The movable blade of the blade set 26 that is not visible in FIG. 2 is operated and actuated via a driving engagement element 48 that may also be referred to as driving bridge. At the element 48, a driving or engagement slot is formed that is engaged by a driving pin 50 of a driving shaft 52. The driving shaft 52 is rotated about a driving axis 54, refer to a curved arrow 56. The driving pin 50 is off-centered with respect to the driving axis 54. Consequently, as the driving pin 50 is revolving, a reciprocating movement of the movable blade with respect to the stationary blade 42 is effected.

In FIG. 2, there is further indicated a pivot mechanism 58 which may be referred to as a contour following feature. The mechanism 58 enables a certain pivot movement of the blade set 26 about the Y-axis.

Figure 3:
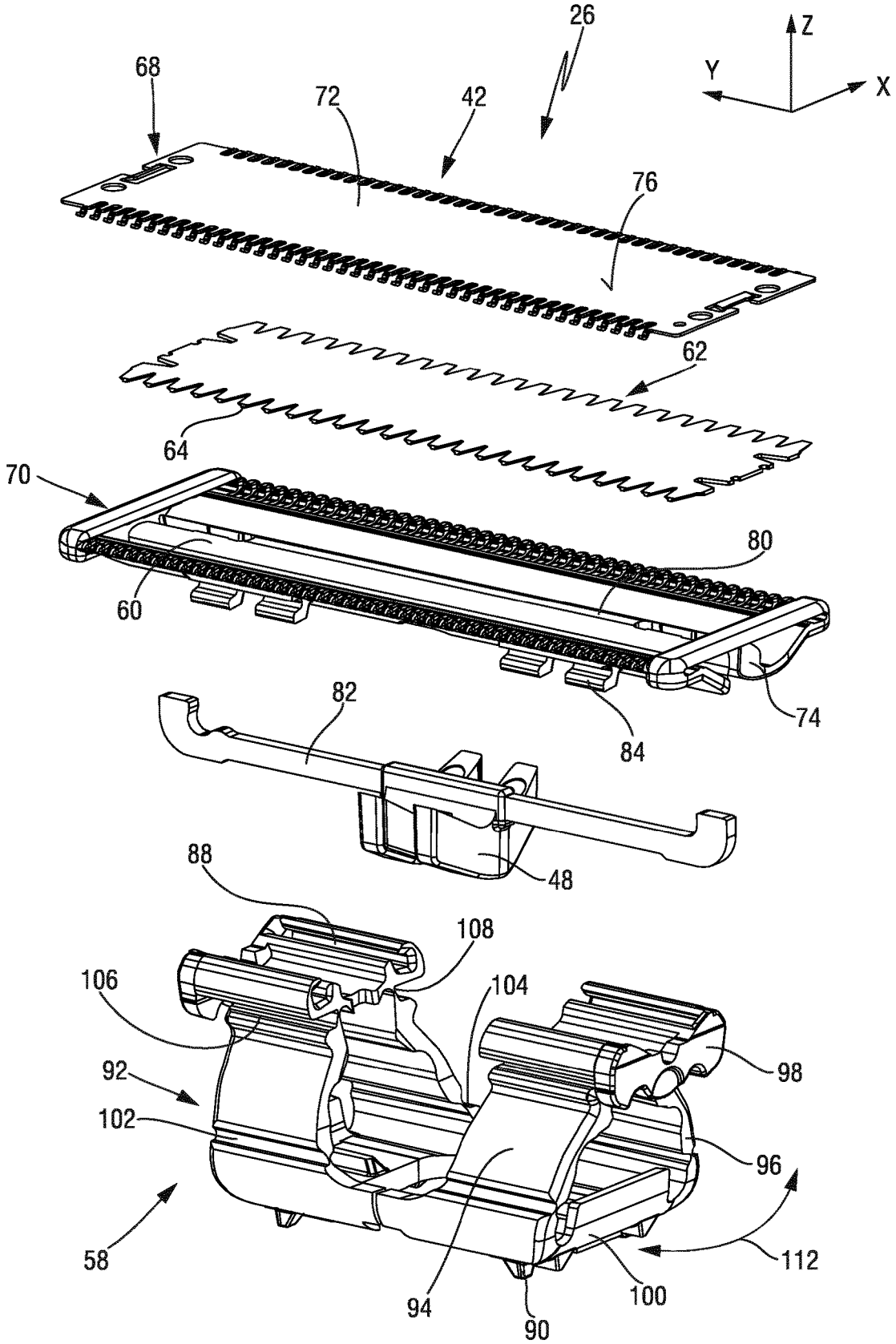
FIG. 3 shows an exploded perspective top view of a blade set and a contour following mechanism in accordance with the arrangement shown in FIG. 2.

With reference to FIGS. 3 to 7, exemplary insights and aspects of the present disclosure will be described and discussed in more detail. Embodiments described hereinafter may be thus implemented in the general layout of the appliance 10 as illustrated in FIG. 1, and/or the processing head 24 as illustrated in FIG. 2. For illustrative purposes, FIG. 3 shows an exploded view of the arrangement of FIG. 2 in a similar view orientation, wherein for illustrative purposes several components have been omitted.

As indicated above, the processing head 24 incorporates a blade set 26 which is arranged as a powered (motor operated) blade set. Generally, the processing head 24 may also be referred to as cutting head. The blade set 26 comprises a stationary blade 42 (refer to FIG. 2), and a movable blade 62 that is arranged in a guide slot 60 defined by the stationary blade 42. The movable blade 62 comprises movable blade teeth 64 that are arranged to cooperate with the stationary blade teeth 44 at the two leading edges 32, 34. It is noted in this context that the blade set 26 may comprise, in alternative embodiments, only a single leading edge where stationary blade teeth 44 and movable blade teeth 64 cooperate.

In accordance with at least some exemplary embodiments, the stationary blade 42 is a double-walled blade comprising a first, top wall 72 and a second, bottom wall 74. In the exemplary embodiment illustrated in FIG. 3, the stationary blade 42 is composed of a metal component 68 and a plastic component 70. The metal component 68 defines and forms a major part of the top wall 72. The plastic component 70 defines and forms the bottom wall 74 placed at the bottom side of the blade set 26. A top surface of the top wall 72 is indicated by reference numeral 76. In the operating state of the blade set 26, the top wall 72 at the top side of the blade set 26 faces the skin to cut hair.

Optionally, in other alternative embodiments, the top wall 72 and the bottom wall 76 are entirely formed from metal material. In the embodiment in accordance with FIG. 3, the stationary blade 42 is an integrally manufactured metal-plastic composite part. By way of example, the metal component 68 may form an insert that is arranged in a mold that is used in an injection molding procedure to form the plastic component 70 and to bond the plastic component 70 with the metal component 68.

As the plastic component 70 is an injection-molded part, at least in some embodiments, further design features may be formed thereon. For instance, a driving slot 80 is formed in a central portion of the plastic component 70. In the mounted state of the processing head 24, a driving connector 82 is arranged in and extends through the driving slot 80 from a bottom side thereof into the guide slot 60. In the guide slot 60, the driving connector 82 is attached to the movable blade 62. As indicated in FIG. 3, at the driving connector 82 the driving engagement element 48 is provided so that a drive train of the hair cutting appliance 10 may actuate the movable blade 62 to induce a reciprocating movement with respect to the stationary blade 42. As a further result, when the driving connector 82 is attached to the movable blade 62, the assembly state of the movable blade 62 in the guide slot 60 is secured.

At the plastic component 80, there may be further formed mounting features 84, for instance snap-in hooks, etc. The mounting features 84 are provided at a bottom side of the plastic component 70 to attach the blade set 26 to the contour following mechanism 58. At the contour following mechanism 58, a mating snap-lock interface 88 is provided that may involve, for instance, recesses that are arranged to be engaged by the mounting features 84 of the blade set 26. Hence, a snap-lock connection is possible so that the blade set 26 is detachable, for instance for replacement.

At a bottom side of the contour following mechanism 58 that is facing away from the blade set 26, a further mounting interface 90 is provided. Via the mounting interface 90, the contour following mechanism 58 and, consequently, the blade set 26 may be attached to a housing 12 of the hair cutting appliance 10.

In the exemplary embodiment of FIG. 3, the contour following mechanism 58 incorporates a linkage unit 92 that is arranged as a four-bar linkage unit. The linkage unit 92 comprises a first side bar 94 and a second, opposite side bar 96. Further, a top bar 98 is provided that connects the first side bar 94 and the second side bar 96. At the bottom end of the linkage unit 92, a bottom bar 100 is provided. At the bottom bar 100, the mounting interface 90 is formed. At the top bar 98, the snap-lock interface 88 for the blade set 26 is formed.

As illustrated in FIG. 3, the linkage unit 92 may involve two respective linkages, each involving a first side bar 94, a second side bar 96, a top bar 98 and a bottom bar 100. The linkages are offset from one another in the longitudinal direction (Y-direction). Hence, optionally, the linkage unit 92 is a split linkage unit.

Between the bottom bar 100 and the first side bar 94, a hinge 102 is provided. Between the bottom bar 100 and the second side bar 96, a hinge 104 is provided. Between the first side bar 94 and the top bar 98, a hinge 106 is provided. Between the second side bar 96 and the top bar 98, a hinge 108 is provided. Hence, four swivel bars are provided that are respectively coupled by the hinges 102, 104, 106, 108. As a result, a contour following pivot movement 112 is possible for the top bar 98 and, consequently, for the blade set 26 attached thereto.

It is to be noted that the top bar 98 and/or the bottom bar 100 do not necessarily have to be arranged as distinct elements. Optionally, the top bar 98 may be embodied by the bottom wall 74 of the stationary blade 42. Similarly, the bottom bar 100 may be embodied by the housing 12 of the hair cutting appliance, refer also to FIG. 1 and FIG. 4.

Arranging the linkage unit 92 as a four-bar linkage may have the result that the pivot movement 112 that is induced at the top bar 98 actually involves a virtual (instantaneous) pivot axis that is defined in a region where actually no discrete pivot axis is possible, due to manufacturing constraints, assembly space constraints, etc. Further, such a virtual pivot axis is an instantaneous pivot axis. In other words, the actual position of the virtual pivot axis depends on the actual pivot state of the linkage unit 92.

Having introduced the processing head 24 and the blade set 26 in detail herein before, reference is now made to FIGS. 4 to 7 that illustrate an enhanced design of a processing head for a hair cutting appliance 10.

Figure 4:
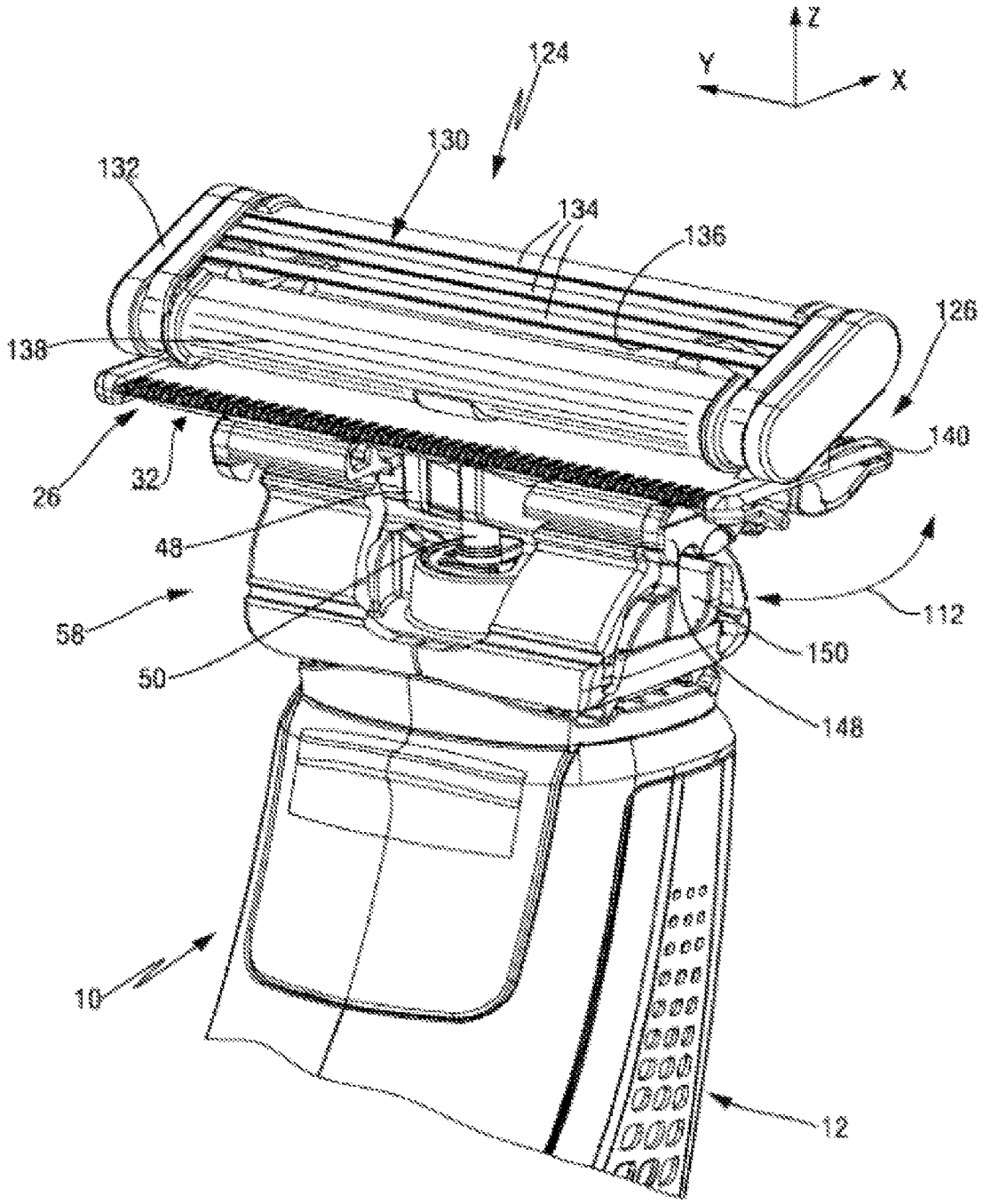
FIG. 4 is an enlarged perspective top view of an exemplary embodiment of a processing head that utilizes at least some components of the arrangement shown in FIGS. 1 to 3.

As shown in FIG. 4, a processing head 124 may be provided that implements, in at least some embodiments, a combined blade unit 126. The blade unit 126 is provided with the blade set 26 that is generally arranged as discussed herein before. Insofar, the description of the blade set 26 in connection with FIGS. 1 to 3 still applies.

However, the combined blade unit 126 is augmented as also a razor blade 130 is provided in addition to the powered blade set 26. As can be seen in FIG. 4, the razor blade 130 is arranged at the stationary blade 42 of the blade set 26. The razor blade 130 may be attached to and/or integrally formed with the stationary blade 42. The razor blade 130 is not powered by a motor.

The razor cartridge 130 comprises a frame 132 that supports and carries at least one blade 134 or a row of blades 134. In the exemplary embodiment of FIG. 4, in total three blades 134 are provided one after another. Each of the blades 134 is provided with a sharp cutting edge 136 that is configured for shaving procedures, particularly for wet shaving procedures.

Further, in the exemplary embodiment of FIG. 4, a skin preparation zone 138 is arranged in front of the blades 134. The preparation zone 138 may involve a relatively soft material, such as rubber, silicone, elastomer materials, etc. When the razor blade 130 is in operation, first the preparation zone 138 contacts a certain skin portion. The preparation zone 138 may be provided to raise flattened hairs. Hence, in a shaving operation, as the razor blade 130 is advanced, at least one of the blades 134 contacts the hairs and cuts or chops the hairs very close to the skin.

In FIG. 4 there is further indicated a connector 140 that is used for the attachment of the razor blade 130 at the stationary blade 42 of the blade set 26.

A main aspect of the arrangement of the processing head 124 illustrated in FIG. 4 is that the razor blade 130 also uses the contour following mechanism 58 as the razor blade 130 is attached to the stationary blade 42. As a result, the contour following mechanism 58 may also enable a contour following pivot movement of the razor blade 130 as the processing head 124 is advanced along a movement path at the skin.

There may be several embodiments of the connector 140. In some embodiments, the razor blade 130 is permanently attached to the stationary blade 42. This may involve an integral and combined manufacture. Optionally, the blade set 26 and the razor blade 130 may be separately produced and bonded with one another to form the combined blade unit 126. Optionally, the bonding procedure may involve any of welding, gluing, soldering, riveting, etc. Further, integral manufacture methods such as insert molding may be used.

In alternative embodiments, the razor blade 130 is arranged to be attached to and detached from the stationary blade 42 by means of an interface, for instance a snap-lock or snap-on/snap-in/snap-lock interface.

As shown in FIG. 4, the cutting edges 136 of the razor blade 130 are basically parallel to the leading edge 32. This has the effect that a rather similar or nearly identical advancing movement (arrow 38 in FIG. 1) may be used to operate any of the razor blade 130 and the leading edge 32 of the blade set 26.

The appliance illustrated in FIG. 4 may be used for trimming procedures, using the powered blade set 26, and for (wet) shaving procedures, using the razor blade 130. It is to be noted in this context that in at least some embodiments, the powered blade set 26 is also capable of shaving, particularly when the top wall 72 of the stationary blade 42 is considerably thin. However, it has been observed that an even smoother shave may be achieved when using the razor blade 130 in addition to the powered blade set 26.

The arrangement illustrated in FIG. 4 has the further effect that basically one and the same grip position may be used to operate any of the razor blade 130 and the powered blade set 26. Therefore, it is not necessary to change the grip position when switching between the razor blade 130 and the powered blade set 26. Optionally, also a combined operating mode for trimming with the powered blade set 26 and shaving with the razor blade 130 in one stroke is possible.

Further, as the blades 134 of the razor blade 130 and the leading edge 32 of the powered blade set 26 are relatively close to one another, visibility and reachability conditions basically remain the same.

In FIG. 4 there is further shown a limiter 148 that is arranged to cooperate with a limit stop 150. The limit stop 150 is arranged at or coupled with the bottom bar 100 of the linkage unit 92. At the top bar 98 of the linkage unit 92, a limiter 148 is provided that cooperates with the limit stop 150. In this way, a maximum level of relative rotation between the top bar 98 and the bottom bar 100 may be defined. The limit stop 150 also defines a maximum contour following pivot movement for any blade of the combined blade set 126.

Figure 5:
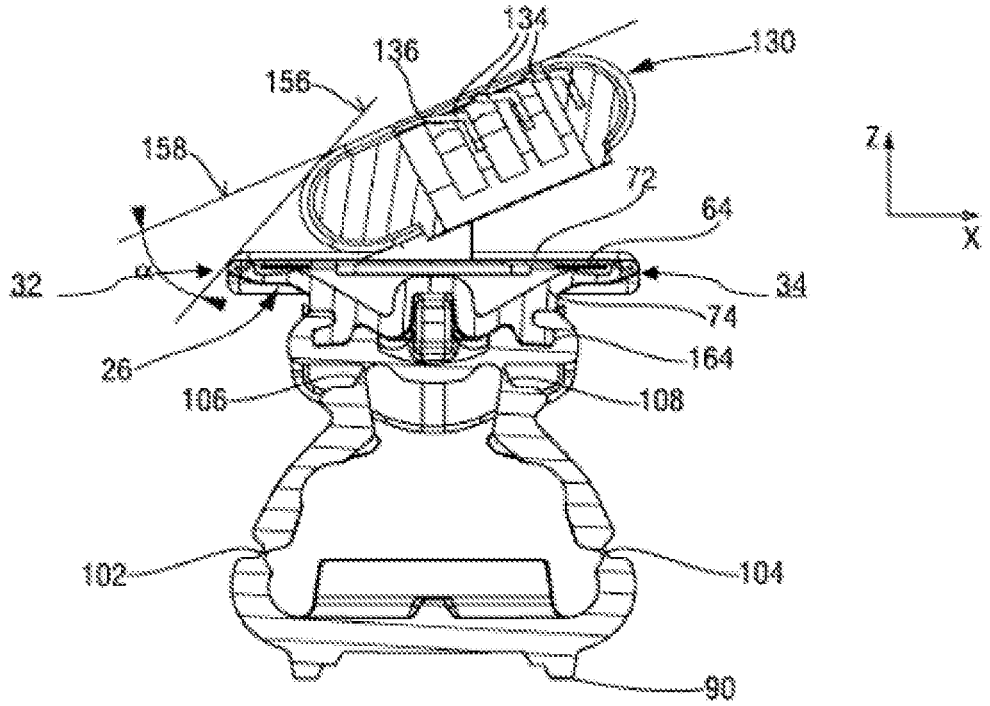
FIG. 5 shows a cross-sectional side view of the processing head of FIG. 4, wherein for illustrative purposes several components have been omitted.
Figure 6:
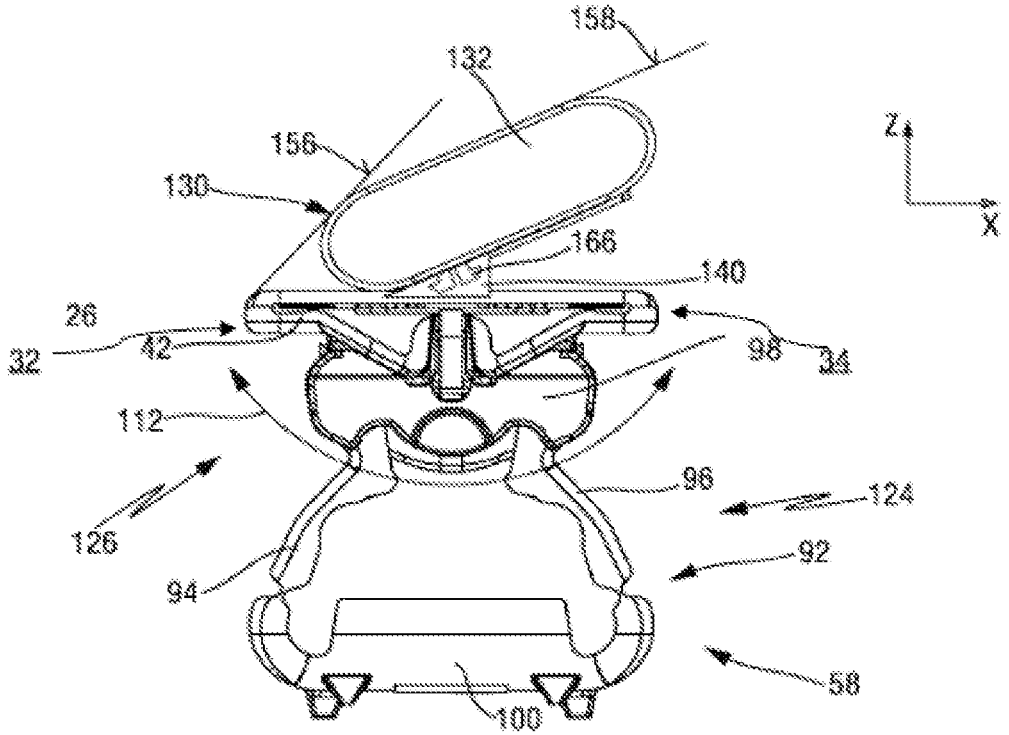
FIG. 6 shows a side view of the arrangement of FIG. 5.

FIG. 5 and FIG. 6 show side views of the processing head 124 using the combined blade unit 126. FIG. 5 is a cross-sectional view. FIG. 6 is a standard side view.

In FIG. 5 and FIG. 6, there is further illustrated the linkage unit 92 of the contour following mechanism. As can be best seen from FIG. 5, at least some of the hinges 102, 104, 106, 108 may be arranged as living hinges. In other words, the hinges 102, 104, 106, 108 do not incorporate distinct and separate pivots. Rather, a relative pivoting movement between the bars 94, 96, 98, 100 of the linkage unit 92 is possible as the hinges 102, 104, 106, 108 are defined by portions having a considerably thin wall thickness.

In at least some embodiments, the linkage unit 92 is a single integrally formed component. This has a positive effect on manufacturing costs, assembly costs, durability, etc.

In the cross-sectional view of FIG. 5, also the mounting feature 84 and the snap-lock interface 88 between the stationary blade 42 and the contour following mechanism 58 are illustrated. The connector 140 that connects the razor blade 130 and the stationary blade 42 may be similarly shaped and use similar elements. However, in alternative embodiments, the connector 140 forms a permanent connection between the stationary blade 42 and the razor blade 130.

The mounting features 84 and the snap-lock interface 88 form a mounting interface 164 arranged as a snap-lock connection. In FIG. 6, reference numeral 166 indicates a similar snap-lock connection 166 between the blade set 26 and the razor blade 130, to form the combined blade set 126.

In FIG. 5 and FIG. 6, for illustrative purposes an imaginary operating orientation 156 defined by a leading edge 32 of the blade set 26 and a frontal end of the razor blade 130 is indicated. Similarly, an imaginary operating orientation 158 of the razor blade 130 is shown. Between the two orientations 156, 158, a certain angular offset a (alpha) is present. Reference numerals 156, 258 illustrate a potential contact area/orientation in the respective (distinct) operating mode when the appliance 10 is used either with the razor blade 130 or with the powered blade set 130.

Preferably, the offset angle $\alpha$ is considerably small, and may be for instance less than 30 degrees, preferably less than 15 degrees, more preferably less than 10 degrees. As a result, only a slight change of the overall orientation of the processing head 124 with respect to the skin is necessary to switch between the operation of the powered blade set 26 and the operation of the non-powered razor blade. This has a positive effect on visibility, reachability, and on the overall operating performance of the processing head 124.

Further, in at least some embodiments, a parallel (simultaneous) cutting action involving both the razor blade 130 and the powered blade set 26 is possible. To this end, the angle $\alpha$ between the two imaginary orientations 156, 158 may approach zero, resulting in the desired parallel (simultaneous) engagement of the razor blade 130 and the powered blade set 26 in a respectively operable orientation.

Figure 7:
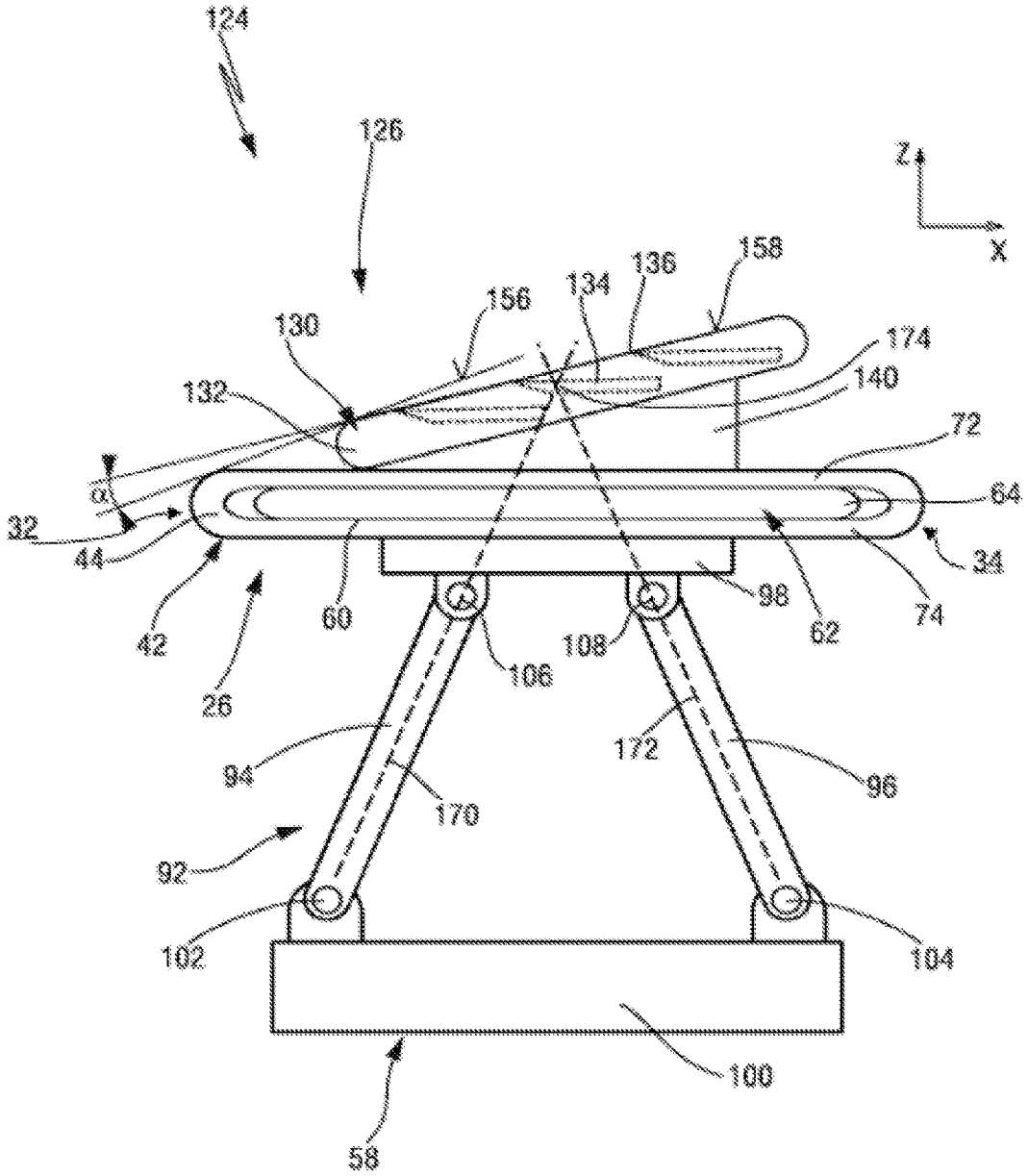
FIG. 7 shows a simplified side view of an exemplary embodiment of a processing head comprising a combined blade unit that is attached to a contour following mechanism.

FIG. 7 illustrates a schematic lateral view of another exemplary embodiment of a processing head to explain an exemplary kinematical context.

As with the embodiments already discussed herein before, the processing head 124 illustrated in FIG. 7 involves a combined blade unit 126 incorporating a blade set 26 and a razor blade 130. The razor blade 130 is arranged on top of a stationary blade 42 of the blade set 26, and at least temporarily fixed therewith. At the razor blade 130, several blades 134 are provided. At the blade set 26, a movable blade 62 is provided that is movably retained in a guide slot 60 defined by a stationary blade 42. To attach the combined blade set 126 to a housing of the hair cutting appliance 10, a linkage unit 92 is provided that is operable as a contour following mechanism 58.

As already discussed herein before, the linkage unit 92 comprises a top bar 98, a bottom bar 100, and side bars 94, 96. For illustrative purposes, discrete hinges 102, 104, 106, 108 are shown in FIG. 7. Optionally, living hinges that are integrally formed, may be used.

The operating orientation 156 for the blade set 26, particularly for the first leading edge 32 thereof, is defined by the tips of the stationary blade teeth 44, and by the shape of the frame 132 of the razor blade 130 which is present at the top wall of the stationary blade 42. The operating orientation 158 of the razor blade 130 is defined in the exemplary embodiment of FIG. 5 by a connecting line connecting the tips of the blades 134 of the razor blade 130. Preferably, the connecting line intersects or approaches frontal tips of the teeth 44 at the first leading edge 32. This would result in an embodiment where the orientations 156 and 158 are not only parallel but coinciding or basically coinciding. That is, the angle $\alpha$ equals or comes close to zero in this case. When the processing head 24 is positioned and moved in such a way that the skin level is basically aligned with the resulting plane, then a parallel dual-stage cutting procedure is possible.

Connecting lines 170, 172 that respectively connect two of the hinges 102, 104, 106, 108 form at their point of intersection an instantaneous virtual pivot 174. The design of the linkage unit 92 may be adapted to achieve a desired motion transmission characteristic. As shown in FIG. 7, the instantaneous virtual pivot 174 is arranged above the top surface 76 of the stationary blade 42.

It is to be noted that while aspects and embodiments of the present disclosure have been described with reference to a double-wall arrangement of the stationary blade 42 of the powered blade set 26, this shall not be understood to be limiting. Rather, optionally, alternative embodiments of the powered blade set 26 are possible that implement a single-wall stationary blade 42 that is not provided with a bottom wall 74 in addition to the top wall 72. In such a case, mounting interfaces for the blade set 26 are not formed at the bottom wall but rather at a frame or support thereof.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A processing head for a hair cutting appliance, the processing head comprising:

a powered blade set comprising a stationary blade and a movable blade, wherein the movable blade is arranged to be moved with respect to the stationary blade to cut hair between teeth of the movable blade and teeth of the stationary blade, a linkage unit supporting the powered blade set, wherein the linkage unit enables a contour following pivoting movement of the powered blade set when the appliance is operated to cut hair, and a razor cartridge that is arranged to be attached on the stationary blade of the powered blade set in such a way that the powered blade set and the razor cartridge are pivotably supported by the linkage unit, wherein the razor cartridge is removably attached to the powered blade set, wherein the razor cartridge is inclined with respect to the powered blade set to provide an angular mounting for the processing head to be operable in a first operating orientation for the powered blade set and a second operating orientation for the razor cartridge, and wherein an aligned arrangement of the first operating orientation and the second operating orientation provides a simultaneous interaction of the powered blade set and the razor cartridge with the skin.

2. The processing head as claimed in claim 1, wherein a snap lock interface is formed between the razor cartridge and the powered blade set.

3. The processing head as claimed in claim 1, wherein the razor cartridge is attached to a skin-facing position of the stationary blade of the powered blade set.

4. The processing head as claimed in claim 1, wherein the razor cartridge is provided with a cutting edge that is parallel to a leading edge of the powered blade set that is defined by tips of the teeth of the stationary blade.

5. The processing head as claimed in claim 1, wherein the linkage unit defines a virtual pivot axis for the powered blade set and the razor cartridge.

6. The processing head as claimed in claim 1, wherein the linkage unit is a four-bar linkage unit.

7. The processing head as claimed in claim 6, wherein the four-bar linkage unit comprises a first side bar, a second side bar and a top bar, wherein the first side bar and the second side bar are spaced away from one another, wherein the top bar is arranged between a top end of the first side bar and a top end of the second side bar, and wherein a bottom side of the powered blade set is arranged at or forms the top bar.

8. The processing head as claimed in claim 6, wherein at least one hinge of the linkage unit is a formed as a living hinge.

9. The processing head as claimed in claim 1, wherein the razor cartridge is inclined with respect to the powered blade set in such a way that the processing head is operable to engage the user's skin with the powered blade set and the razor cartridge simultaneously in one stroke so that first the powered blade set and second the razor cartridge approaches a particular processing zone to cut hair.

10. The processing head as claimed in claim 1, wherein, at a stroke movement of the processing head, the processing head has a first inclination with respect to the skin for a shaving procedure and a second inclination with respect to the skin for a trimming operation.

11. The processing head as claimed in claim 1, wherein the movable blade is located on a surface of the stationary blade facing away from the skin.

12. The processing head as claimed in claim 1, wherein the stationary blade comprises a metal wall and a plastic wall.

13. The processing head as claimed in claim 1, wherein the first operating orientation and the second operating orientation are inclined in relation to one another by an angle of less than 30 degrees.

14. A combined blade unit for a hair cutting appliance, the blade unit comprising:

a powered blade set comprising a stationary blade and a movable blade, wherein the movable blade is arranged to be moved with respect to the stationary blade to cut hair between teeth of the movable blade and teeth of the stationary blade, and a razor cartridge that is arranged to be attached to the powered blade set in such a way that the powered blade set and the razor cartridge are pivotably supported by a linkage unit, wherein the razor cartridge is removably attached on the stationary blade of the powered blade set, wherein the razor cartridge is inclined with respect to the powered blade set to provide an angular mounting for the processing head to be operable in a first operating orientation for the powered blade set and a second operating orientation for the razor cartridge, and wherein an aligned arrangement of the first operating orientation and the second operating orientation provides a simultaneous interaction of the powered blade set and the razor cartridge with the skin, wherein the blade unit is arranged to be coupled with a hair cutting appliance via the linkage unit that pivotably supports the powered blade set and the razor cartridge.

15. The combined blade unit as claimed in claim 14, wherein a snap lock interface is formed between the razor cartridge and the powered blade set.

16. The combined blade unit as claimed in claim 14, wherein the razor cartridge is attached to a skin-facing position of the stationary blade of the powered blade set.

17. The combined blade unit as claimed in claim 14, wherein the linkage unit defines a virtual pivot axis for the powered blade set and the razor cartridge.

18. The combined blade unit as claimed in claim 14, wherein the first operating orientation and the second operating orientation are inclined in relation to one another by an angle of less than 30 degrees.

19. An electrically powered hair cutting appliance, said hair cutting appliance being arranged to be moved through hair in a moving direction to cut hair, said hair cutting appliance comprising:

a processing head having a powered blade set comprising a stationary blade and a movable blade, wherein the movable blade is arranged to be moved with respect to the stationary blade to cut hair between teeth of the movable blade and teeth of the stationary blade, a linkage unit supporting the powered blade set, wherein the linkage unit enables a contour following pivoting movement of the powered blade set when the appliance is operated to cut hair, and a razor cartridge that is arranged to be attached on the stationary blade of the powered blade set in such a way that the powered blade set and the razor cartridge are pivotably supported by the linkage unit, wherein the processing head is fitted with a combined blade unit comprising the powered blade set and the razor cartridge, wherein the razor cartridge is inclined with respect to the powered blade set to provide an angular mounting for the processing head to be operable in a first operating orientation for the powered blade set and a second operating orientation for the razor cartridge, and wherein an aligned arrangement of the first operating orientation and the second operating orientation provides a simultaneous interaction of the powered blade set and the razor cartridge with the skin.

20. The electrically powered hair cutting appliance as claimed in claim 19, wherein the first operating orientation and the second operating orientation are inclined in relation to one another by an angle of less than 30 degrees.

* * * * *